US006341665B1

(12) United States Patent
Zhou et al.

(10) Patent No.: US 6,341,665 B1
(45) Date of Patent: Jan. 29, 2002

(54) RETRACTABLE COUNTERWEIGHT FOR STRAIGHT-BOOM AERIAL WORK PLATFORM

(75) Inventors: Michael Z. Zhou, Hagerstown, MD (US); Robert D. Backer, Rouzerville; Michael D. Griffin, Zullinger, both of PA (US); Mark G. Neubauer, Hagerstown, MD (US)

(73) Assignee: Grove U.S. L.L.C., Shady Grove, PA (US)

( * ) Notice: Subject to any disclaimer, the term of this patent is extended or adjusted under 35 U.S.C. 154(b) by 0 days.

(21) Appl. No.: 09/394,616

(22) Filed: Sep. 13, 1999

(51) Int. Cl.[7] ..... B66C 23/16
(52) U.S. Cl. ..... 182/2.8; 182/69.6; 212/196
(58) Field of Search ..... 212/196, 197, 212/198; 182/69.6, 2.8, 2.9

(56) References Cited

U.S. PATENT DOCUMENTS

| | | | | |
|---|---|---|---|---|
| 252,672 | A | | 1/1882 | Jewett |
| 1,068,279 | A | | 7/1913 | Schrader |
| 1,245,186 | A | | 11/1917 | Brothers |
| 1,497,686 | A | | 6/1924 | Johnson |
| 1,558,614 | A | | 10/1925 | Hooker |
| 2,036,386 | A | | 4/1936 | Andersen |
| 2,198,793 | A | | 4/1940 | Schroeder |
| 2,364,493 | A | | 12/1944 | Ulinski |
| 2,526,613 | A | | 10/1950 | Tanguy |
| 3,153,510 | A | | 10/1964 | Brannfors et al. |
| 3,182,827 | A | | 5/1965 | Frost |
| 3,224,528 | A | | 12/1965 | Hubbard |
| 3,240,353 | A | * | 3/1966 | Leavesley |
| 3,265,218 | A | | 8/1966 | Stefanutti |
| 3,362,432 | A | | 1/1968 | Jameson |
| 3,513,997 | A | | 5/1970 | Heyer et al. |
| 3,584,705 | A | | 6/1971 | Ruegg |
| 3,743,049 | A | | 7/1973 | Levrini |
| 3,752,325 | A | | 8/1973 | Sato et al. |
| 3,856,108 | A | | 12/1974 | Grove |
| RE31,400 | E | | 10/1983 | Rallis et al. |
| 4,476,955 | A | | 10/1984 | Carter |
| 4,524,874 | A | | 6/1985 | ten Broeke et al. |
| 4,567,990 | A | | 2/1986 | Bellio |
| 4,646,875 | A | | 3/1987 | Sholl |
| 4,653,654 | A | * | 3/1987 | McDaniel |
| 4,667,771 | A | | 5/1987 | Tranchero |
| 4,679,336 | A | | 7/1987 | Brocklebank et al. |
| 4,757,875 | A | | 7/1988 | Hade, Jr. et al. |
| 4,775,029 | A | | 10/1988 | MacDonald et al. |
| 5,035,337 | A | | 7/1991 | Juergens |
| 5,355,970 | A | | 10/1994 | Hade, Jr. et al. |
| 5,460,244 | A | | 10/1995 | Burch et al. |
| 5,586,667 | A | | 12/1996 | Landry |
| 5,603,239 | A | | 2/1997 | Chong |
| 5,669,517 | A | | 9/1997 | Donaldson et al. |
| 5,685,563 | A | | 11/1997 | Ottestad |
| 5,697,757 | A | | 12/1997 | Lindsay |
| 5,799,806 | A | | 9/1998 | Cullity |
| 5,884,785 | A | | 3/1999 | Cullity |
| 5,934,491 | A | | 8/1999 | Cullity |

FOREIGN PATENT DOCUMENTS

| | | |
|---|---|---|
| BE | 657864 | 1/1965 |
| EP | 0379448 | 7/1990 |
| GB | 1020635 | 2/1966 |
| GB | 2096097 | 10/1982 |
| JP | 58128938 | 8/1983 |
| JP | 60215933 | 10/1985 |
| JP | 62126097 | 8/1987 |
| RU | 1539162 | 1/1990 |

* cited by examiner

*Primary Examiner*—Alvin Chin-Shue

(57) ABSTRACT

An aerial work platform apparatus includes a shiftable counterweight which shifts in response to movement of the boom in order to maintain optimum balance of the apparatus during movement of the boom and platform. The counterweight shifts towards and away from the front of the apparatus, and also in a vertical direction. Several constructions for shifting the counterweight are disclosed.

29 Claims, 13 Drawing Sheets

RETRACTABLE COUNTERWEIGHT FOR STRAIGHT-BOOM AERIAL WORK PLATFORM

FIELD OF THE INVENTION

The present invention relates to load lifting devices, especially such devices wherein a boom pivots in order to lift or reposition a load. An example of such a device is an aerial work platform.

BACKGROUND OF THE INVENTION

A machine which lifts a load typically experiences forces which tend to tip the machine in the direction of the load as the load is lifted. This occurs, for example, in cranes and aerial work platforms. Conventionally, a counterweight may be provided for the machine in a position which tends to tip the machine in an opposite direction. This provides for better balance during operation, and less stress on certain portions of the apparatus.

In cranes, it is conventional to lift a load by means of a cable, taking up the cable in order to lift a load. It is known to provide a counterweight which shifts in a direction away from the load as the load is lifted in order to balance the crane during the lifting operation. Typically, a crane serves the purpose of lifting and moving a load from one place to another.

A aerial work platform is an example of a machine which lifts a load by pivoting a boom which supports the load. Also, it is typical that the load is supported in varying positions for extended periods of time, rather than merely being lifted from one place and set down in another. The boom may be pivoted in a generally upward direction to lift the load, an in an opposite direction to lower the load or position the load at a lesser height.

In such an apparatus, wherein the load supported by the boom may be considered to be positioned to what will be considered the "front" of the apparatus, the load tends to tip the machine forwardly. A counterweight may typically be positioned at an opposite side of the apparatus at a position which would tend to tip the machine rearwardly. This tends to roughly balance the machine.

However, as the load is lifted by the pivoting boom, the mass of the load and the boom moves in a rearward direction, closer to the balance point of the machine. As a result, the force which tends to tip the machine in a forward direction is reduced progressively as the load is lifted. If the counterweight remains stationary, the net force which may tend to tip the machine rearwardly will increase. If the change in balance is of substantial magnitude, an imbalance situation may occur.

It is known to be desirable to shift the counterweight as the load is lifted in order to better balance the apparatus. It is also desirable to lower the center the gravity of the counterweight as the load is lifted in order to maintain a lower overall center gravity of the apparatus, thus further enhancing stability.

OBJECTS OF THE INVENTION

Accordingly, an object of the present invention is to provide a mounting arrangement for a counterweight in a load lifting apparatus which permits the counterweight to shift in a manner to optimally balance the apparatus as a load is lifted or lowered. A particular object is to achieve this result in a highly efficient manner.

A further object of the invention is to provide such an apparatus wherein the counterweight is movable over a range of motion sufficient to optimally balance the apparatus.

A specific object of the invention is to provide an aerial work platform which remains optimally balanced regardless of the position of the platform, and regardless of the direction to which the platform has been rotated with respect to the supporting chassis of the aerial work platform apparatus.

SUMMARY OF THE INVENTION

The foregoing objects are achieved, in accordance with the present invention, by providing a load lifting apparatus comprising a boom which is pivotable about a horizontal axis for lifting a load, a first end of the boom extending to one side of the horizontal axis being adapted to lift a load, the boom comprising a second end extending from the horizontal axis, a linearly shiftable counterweight, and a link connecting the second end of the boom to the counterweight which shifts the counterweight in a first direction when the boom is pivoted to lift a load and in a second direction when the boom is pivoted to lower the load. The counterweight may also be shifted upwardly and downwardly in response to movement of the boom and load. In preferred embodiments, the boom and counterweight are mounted on a portion of the apparatus which is rotatable about a vertical axis.

An apparatus in accordance with the invention may alternatively comprise a hydraulically driven device, a pneumatically driven device, or an electrically driven device for shifting the counterweight in response to raising and lowering of the boom.

BRIEF DESCRIPTION OF THE DRAWINGS

Preferred embodiments of the invention, as well as the particular advantages of the invention, will be described with reference to the accompanying drawings in which.

DETAILED DESCRIPTION OF PREFERRED EMBODIMENTS

Figure 1:
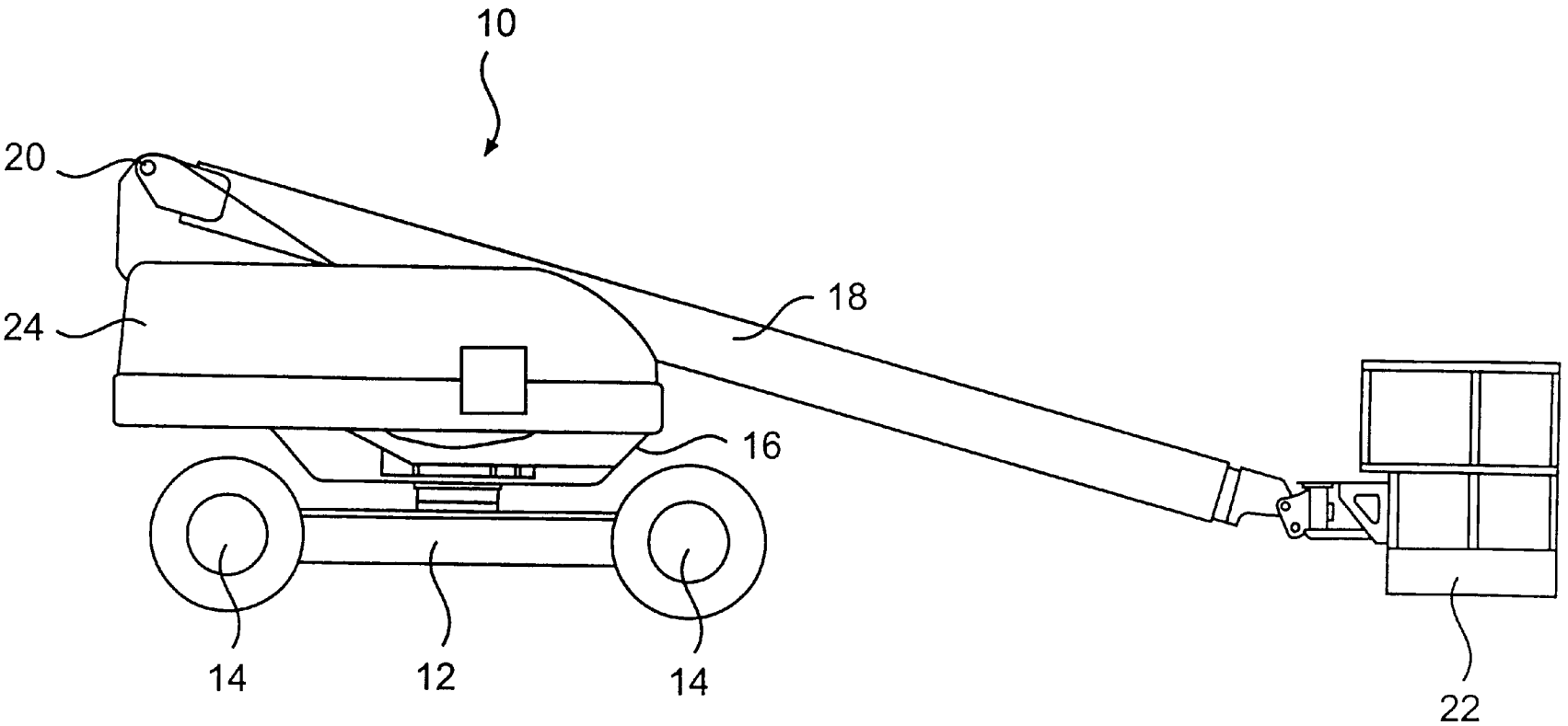
FIG. 1 is a side view of a typical aerial work platform of the straight boom type.

FIG. 1 is a side view of a typical aerial work platform of the straight boom type, designated generally by reference numeral 10. This apparatus includes a chassis 12 supported on wheels 14. A rotatable turret 16 supports a boom 18. Turret 16 rotates about a vertical axis. Boom 18 is pivotable about a horizontal axis 20 whereby it may be raised and lowered. At one end, boom 18 supports a platform 22 for supporting and lifting one or more persons.

Accordingly, platform 22 carries a load which may be supported at a broad range of positions in order to enable the persons on the platform to perform tasks at locations which might otherwise be inaccessible. In order to stabilize the apparatus and prevent the apparatus from tipping as a result of the load on the platform 22, the chassis and turret are typically designed to have a relatively large mass. Particularly, a rearward portion 24 of turret 16 will often include a counterweight of substantial mass. The presence of such mass, particularly at rearward portion 24, generally prevents tipping of the apparatus with platform 22 situated throughout a significant range of positions.

However, it is desirable to provide more precise balance for the aerial work platform apparatus by providing a movable or shiftable counterweight. This enhances the balance of the apparatus during use, and may expand the range of utility of the apparatus.

Figure 2A:
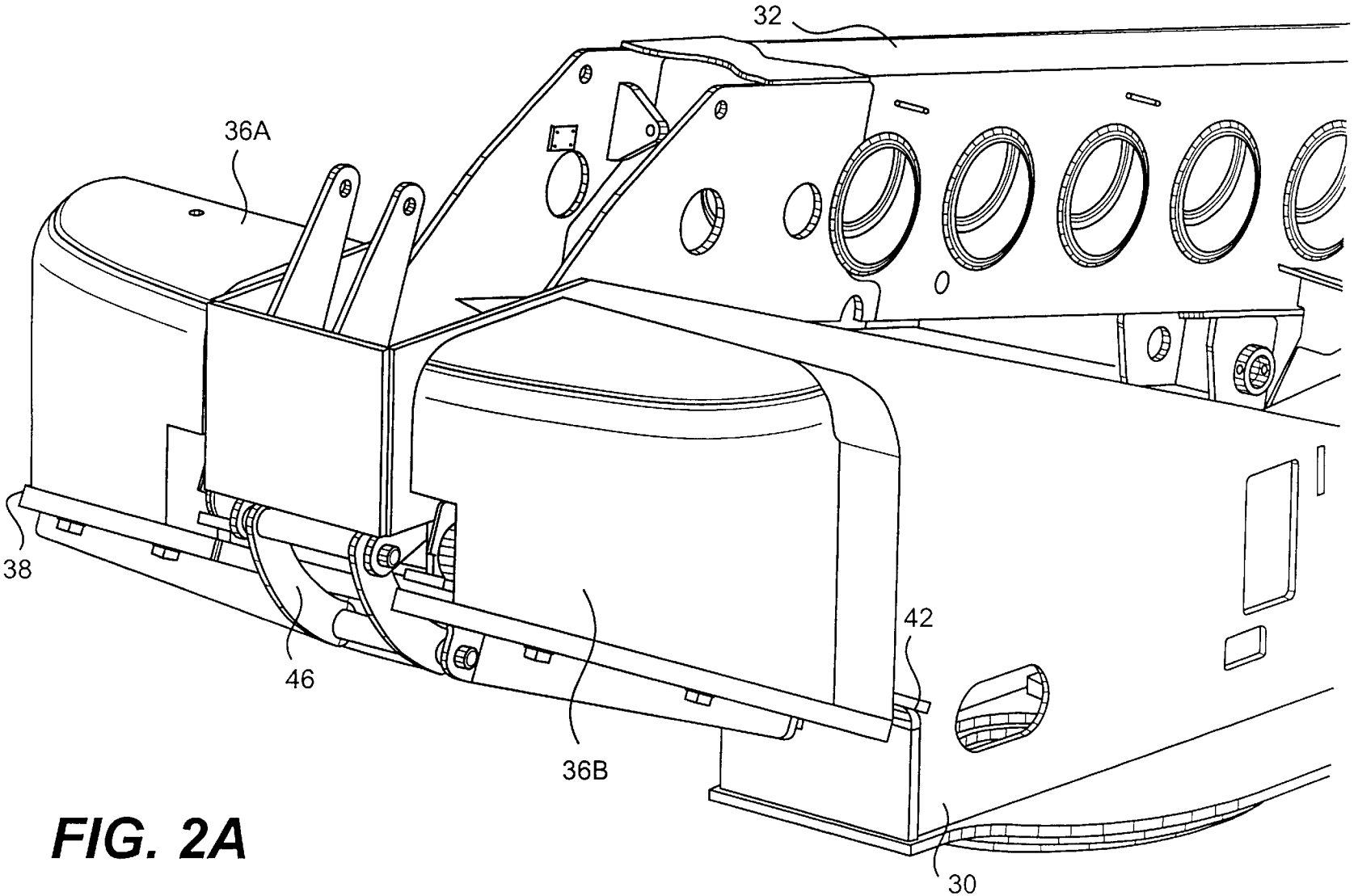
FIG. 2A is a rear perspective view of an aerial work platform in accordance with the invention, illustrating a shiftable counterweight in accordance with the invention.
Figure 2B:
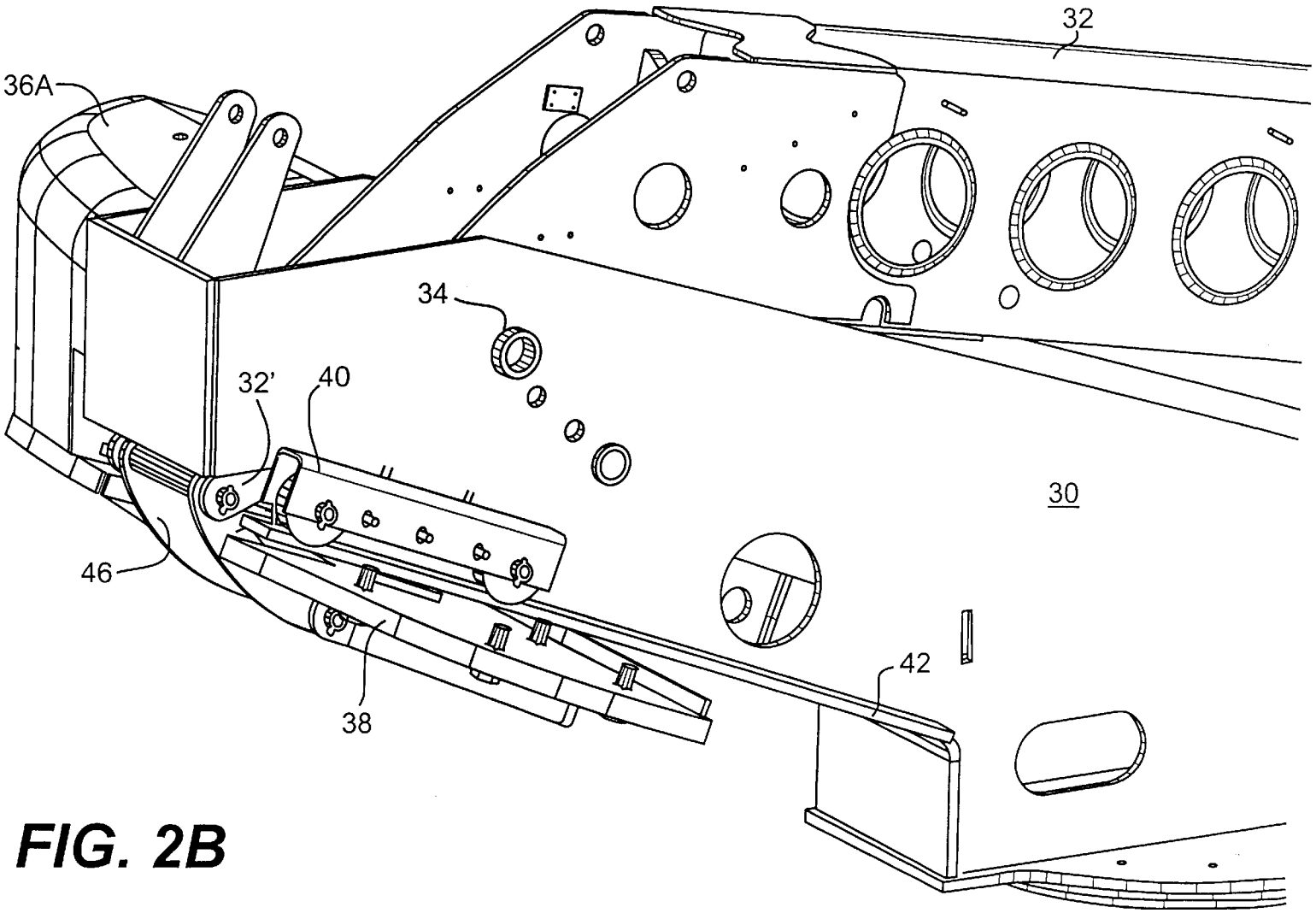
FIG. 2B is a rear perspective view, similar to FIG. 2A, wherein one portion of the shiftable counterweight of FIG. 2A is removed for clarity of illustration.
Figure 3:
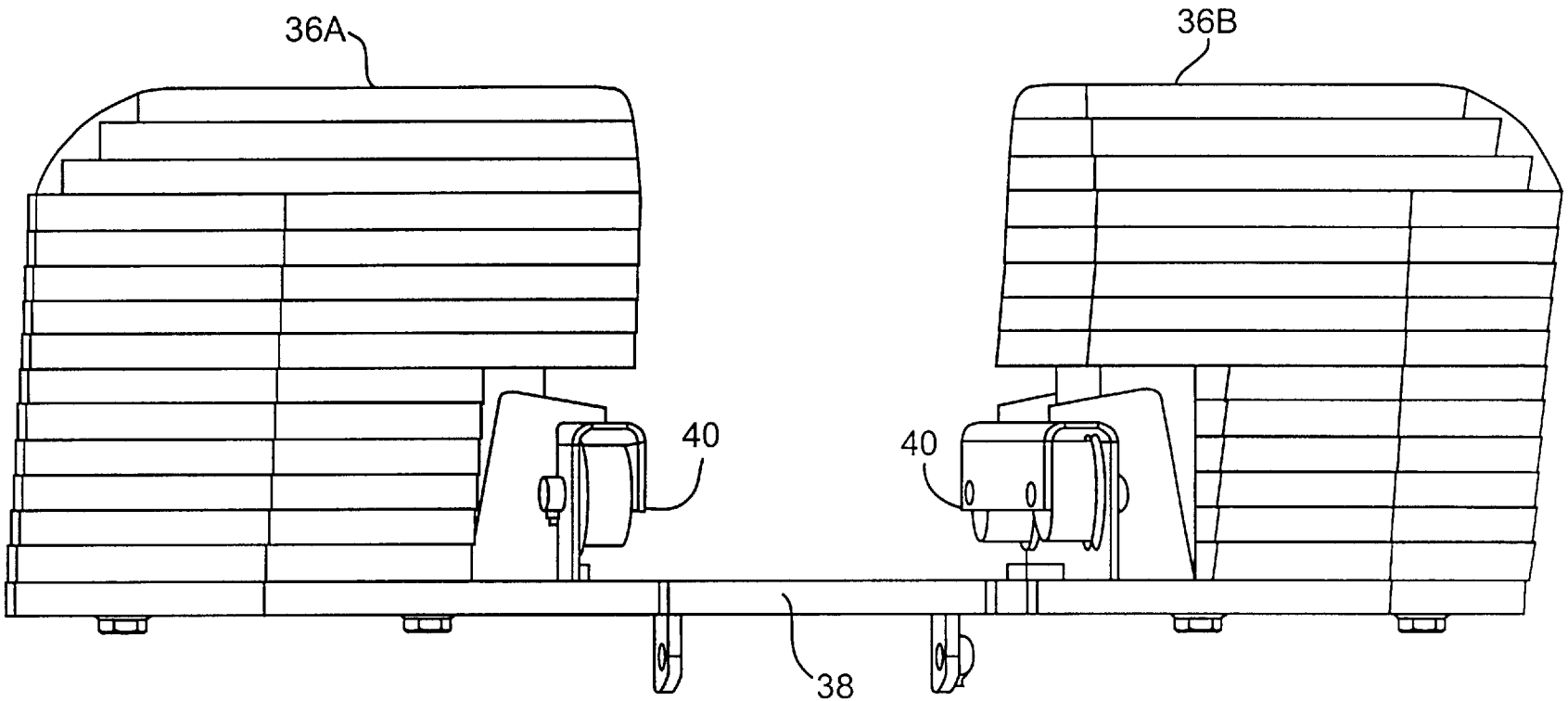
FIG. 3 is a rear view of a counterweight according to a preferred embodiment of the invention.
Figure 4:
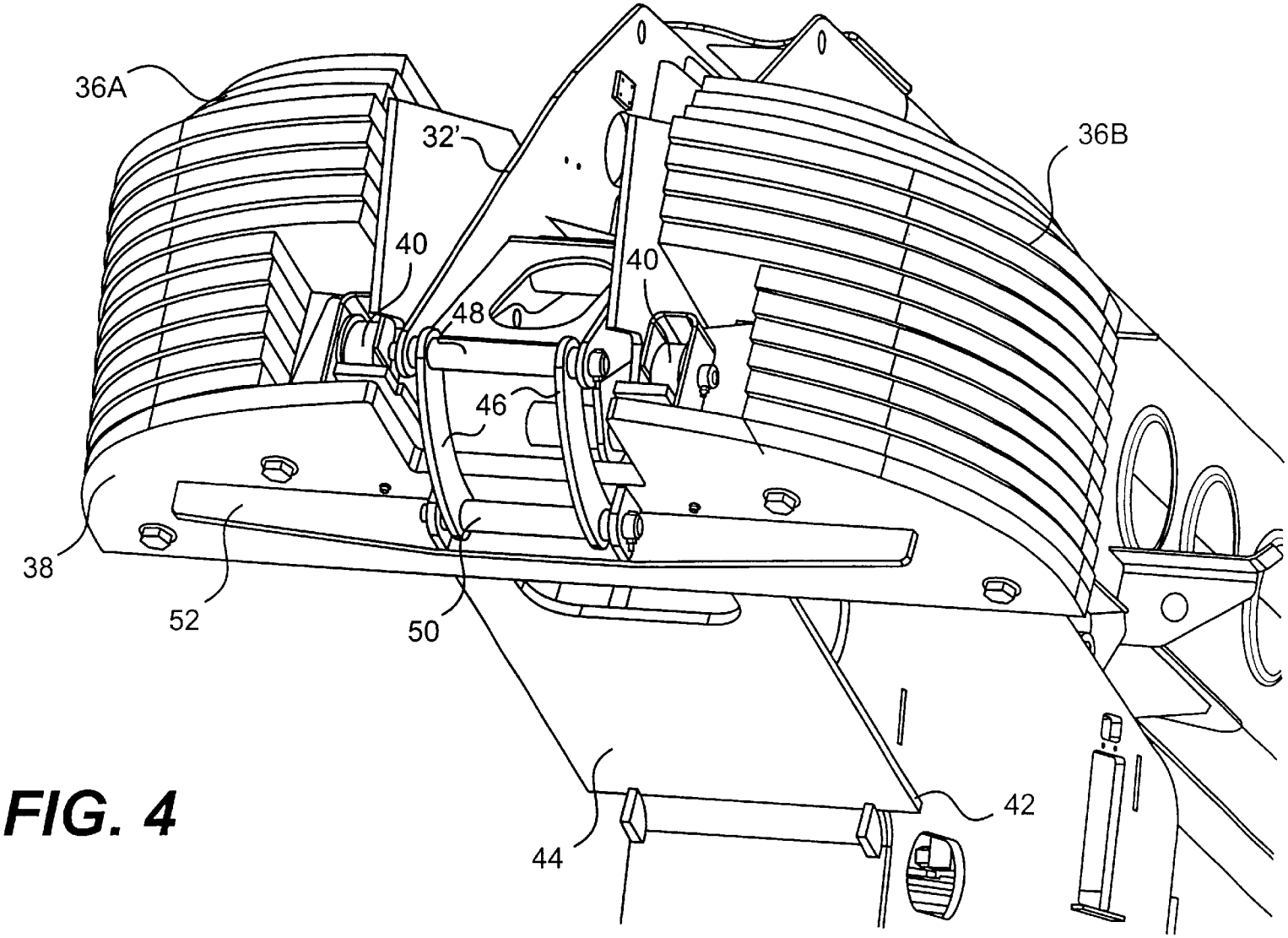
FIG. 4 is a lower rear perspective view of an apparatus in accordance with the invention illustrating the counterweight and link of one preferred embodiment.

FIGS. 2A, 2B, 3 and 4 are illustrative of a first embodiment of an apparatus according to the invention. FIGS. 2A and 2B are partial illustrations of the apparatus, showing only those elements which are important to the present invention. FIG. 3 illustrates the counterweight of the embodiment of FIGS. 2A–2B. FIG. 4 shows the counterweight mounted on the apparatus and connected to a link for shifting the counterweight in response to movement of the boom, as will be described in greater detail hereinafter.

This first embodiment of the invention comprises a turret 30 which is rotatably mounted on a chassis (not shown). As will be described, turret 30 supports counterweights in accordance with the invention. Turret 30 may also support other devices which are not illustrated. The apparatus further comprises a boom 32 which is pivotally mounted at a boom pivot axis 34 (FIG. 2B).

The counterweight 36 in the embodiment illustrated includes symmetrical portions 36A and 36B positioned on opposite sides of turret 30. The illustrated shape of the counterweight portions is exemplary, and should not be considered as limiting. Parts 36A and 36B of the counterweight are joined, in this preferred embodiment, by a table or plate 38. Consequently, all portions of the counterweight will move in unison, as will be described in greater detail hereinafter.

The counterweight further comprises wheels 40. In the illustrated embodiment, wheels 40 comprise sets of wheels attached to table 38. Again, this arrangement is not limiting, but is only exemplary. Wheels 40 are positioned on tracks 42 located on each side of turret 30. As illustrated, tracks 42 are formed by the edges of a plate 44 (FIG. 4) attached to the underside of turret 30. Such a structure for tracks 42 is convenient, but not limiting. Tracks 42 may comprise any form of flanges, rails, etc. associated with turret 30.

In this first embodiment, boom 32 comprises a portion 32' which extends generally rearwardly from pivot axis 34. Boom portion 32' is pivotally connected to a link 46 at a joint 48. Link 46 comprises two parts arranged symmetrically in the illustrated embodiment. These parts act in unison, and the specific form of link 46 is not limited to such an arrangement or configuration.

Link 46 is also joined at a second pivotable joint 50 to counterweight table 38. In the illustrated embodiment, link 46 is connected to table 38 via a flange 52 which is attached to the lower side of table 38. The connection between boom 32 and counterweight 36 via link 46 and the above-described related elements causes the counterweight to shift upon movement of the boom, as will be described with reference to FIGS. 5A–5C.

Figure 5A:
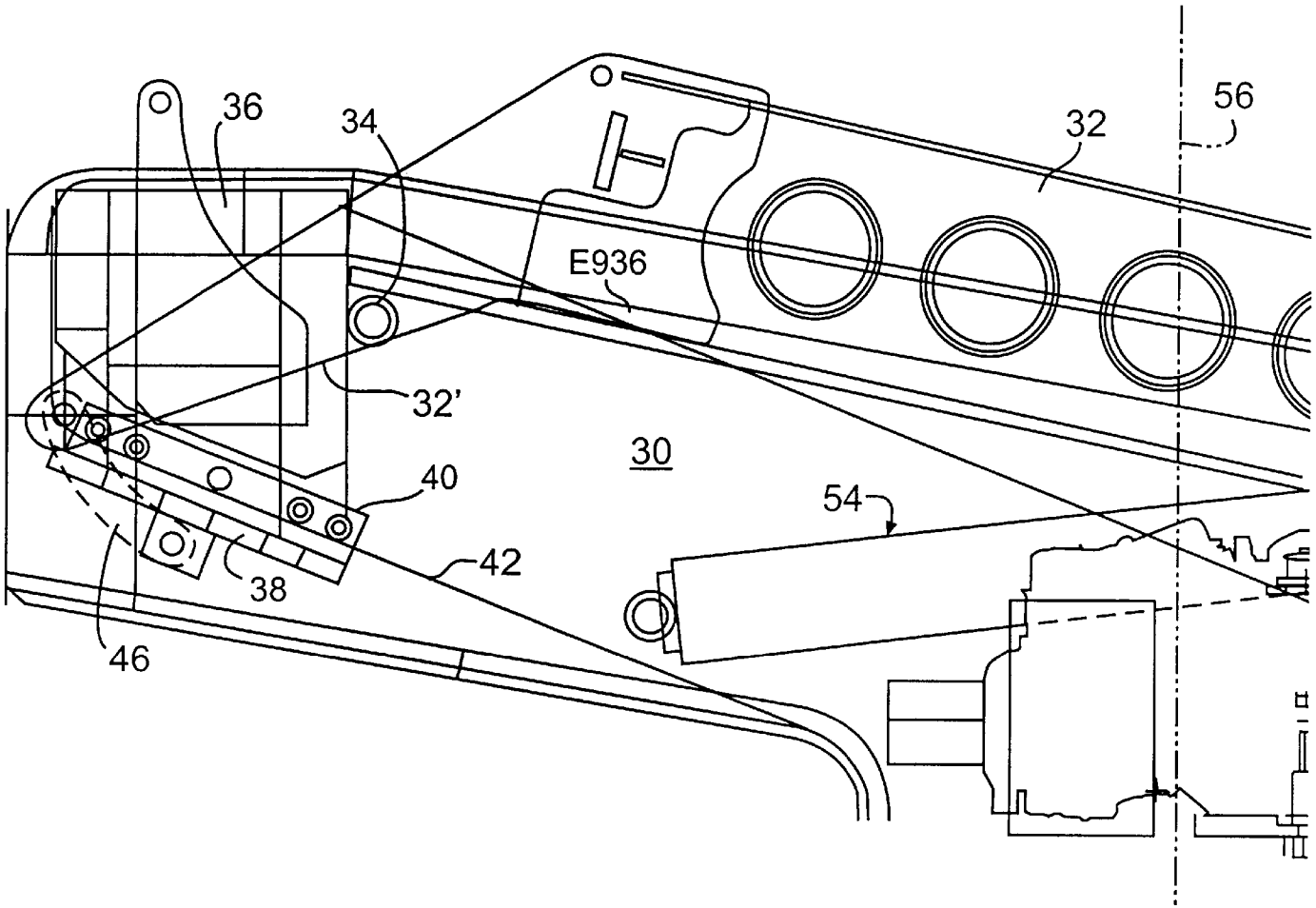
FIGS. 5A–5C are views, partly in section, of the embodiment of FIGS. 2A–4 with the boom in a lowered position, intermediate position and fully raised position, respectively.

FIG. 5A illustrates boom 32 in a fully lowered position, wherein the platform of the aerial work platform (not shown) is similarly fully lowered. A piston and cylinder device 54 is connected between turret 30 and boom 32 for raising a lowering the boom in a well known manner. Counterweight 36 is at its rear-most position on turret 30, supported by wheels 40 on tracks 42. The platform portion of the aerial work platform (not shown) at the end of boom 32 is considered to be at a "forward" or "front" position.

As shown in FIG. 5A, counterweight 36 is also at the highest position along tracks 42. Tracks 42 are inclined downwardly and forwardly, as is apparent from FIG. 5A.

Figure 5B:
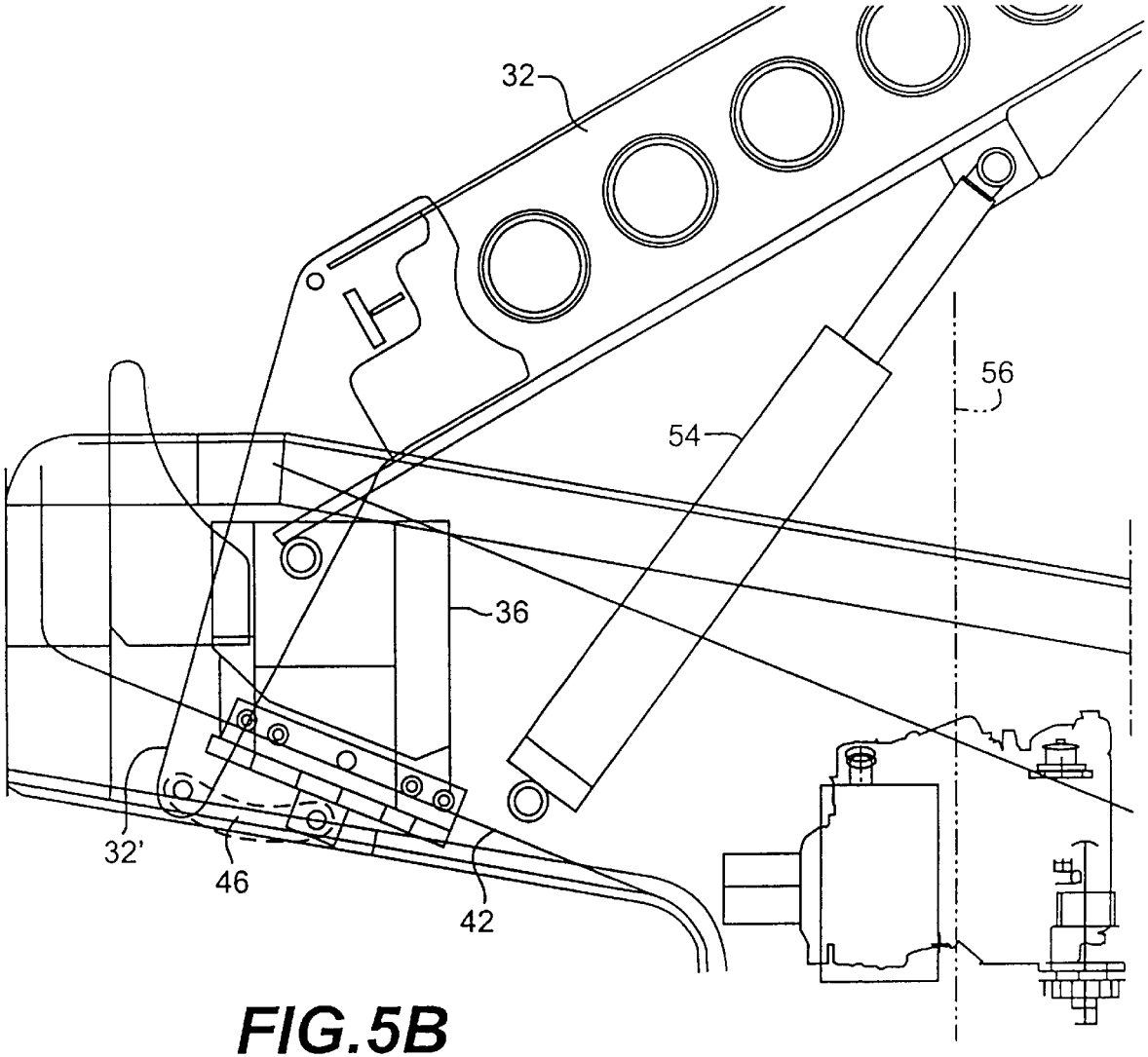

FIG. 5B illustrates the apparatus of FIG. 5A after the boom 32 has been partially raised. Hydraulic fluid has been supplied under pressure to device 54 in order to raise the boom and platform. As a result, boom 32 pivots in a counter clockwise direction about pivot axis 34, raising the boom and platform. Boom portion 32' also pivots in a counter clockwise direction.

As the boom and platform are raised by pivoting about axis 34, the center of mass of the combined boom and platform moves inwardly toward the vertical axis of rotation 56 of turret 30. Simultaneously, as boom portion 32' rotates in a counter clockwise direction, boom portion 32' and link 46 move counterweight 36 along track 42.

As a result, as boom 32 pivots to raise the platform, which moves the platform inwardly toward axis 56, counterweight 36 is also moved inwardly toward axis 56 but from an opposite direction. Consequently, as the platform and its load moves inwardly toward axis 56, reducing the forces which tend to tip the aerial work platform apparatus forwardly, counterweight 36 moves inwardly from the rear of the apparatus, simultaneously reducing the balancing force which tends to tip the apparatus rearwardly. As a result, overall balance of the apparatus is maintained and enhanced throughout movement of the platform.

Additionally, because tracks 42 are inclined, as the platform and its load are raised, the counterweight is lowered. Raising the platform tends to de-stabilize the apparatus by raising its overall center of gravity. This is efficiently and continuously counteracted and balanced by the lowering of the counterweight 36 along inclined tracks 42, which tends to lower the overall center of gravity of the apparatus. In this additional way, an apparatus according to the invention maintains optimal balance throughout the range of motion of the boom and platform.

Figure 5C:
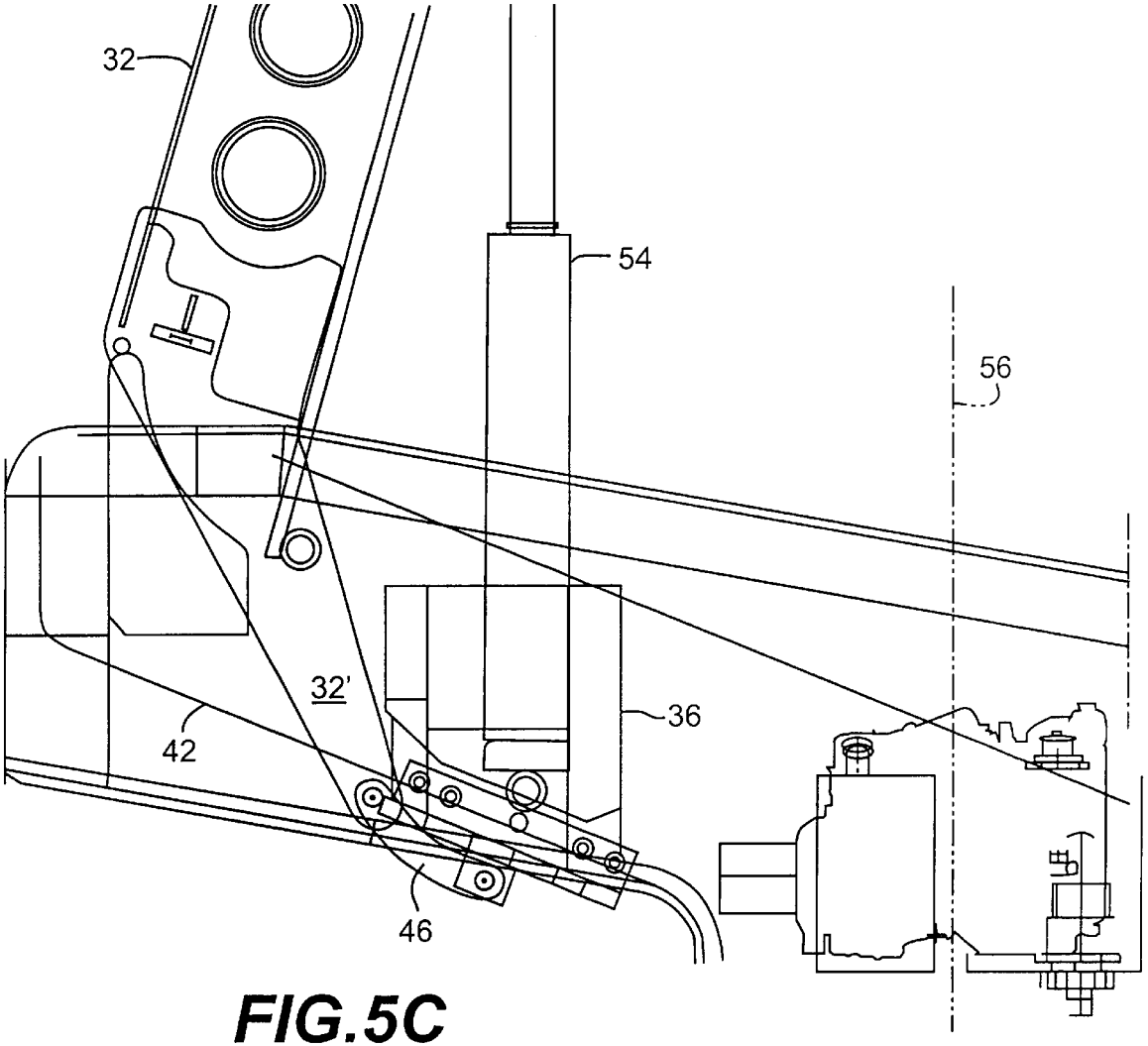

FIG. 5C is an additional view, similar to FIGS. 5A and 5B, showing the apparatus with boom 32 in the fully raised position. When the boom is fully raised in this manner, the platform is positioned substantially above, or relatively near the center of balance of the apparatus which, for the sake of the present description, will be assumed to be at or near vertical axis 56. As a result, the weight of the boom and platform exerts relatively little force which would tend to tip the apparatus forward. In accordance with the invention, counterweight 36 is also moved to a position relatively close to vertical axis 56 whereat is imposes relatively little force which would tend to tip the apparatus rearwardly. Thus, optimum balance is maintained. Additionally, as illustrated in FIG. 5C, counterweight 36 is at its lowest point when the boom 32 is fully raised and the platform is at its highest point. This further enhances stability and balance of the apparatus.

As can be seen in FIGS. 2A–2B, 4 and 5A–5C, boom portion 32' extends from boom pivot axis 34 in a direction which is not parallel to the direction of boom portion 32. Stated somewhat differently, boom portion 32' extends at an angle from a plane which contains boom portion 32. In operation, this orientation of boom portion 32' enables the combination of boom portion 32' and link 46 to shift counterweight 36 over a longer range along tracks 42. This enhances the operation of the apparatus by facilitating optimum balance over a broader range of movement for the boom and platform.

Figure 6A:
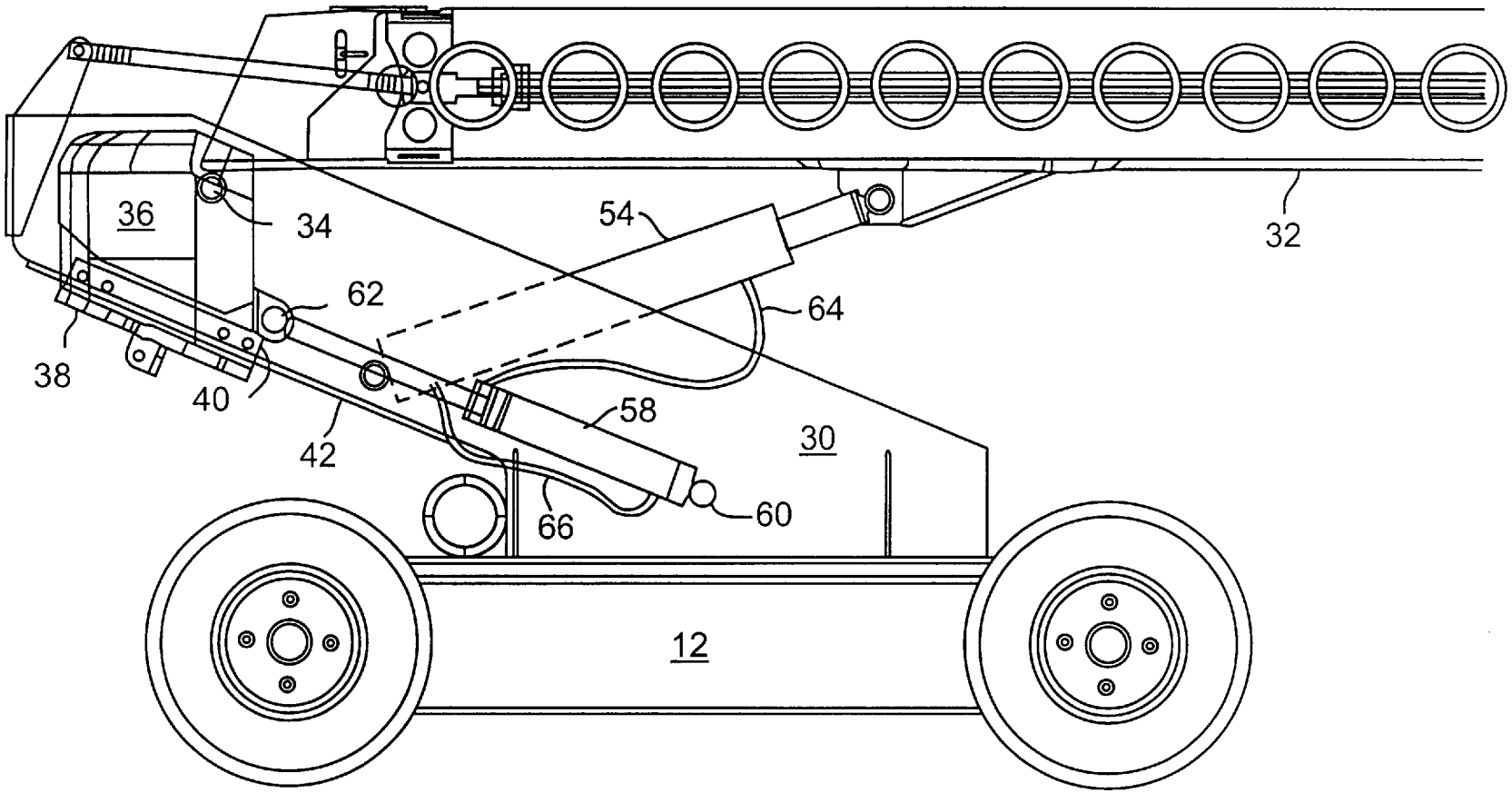
FIG. 6A is side view, partly in section, of a second embodiment of the present invention comprising a hydraulic device for shifting the counterweight, illustrating the boom in a substantially horizontal position.
Figure 6B:
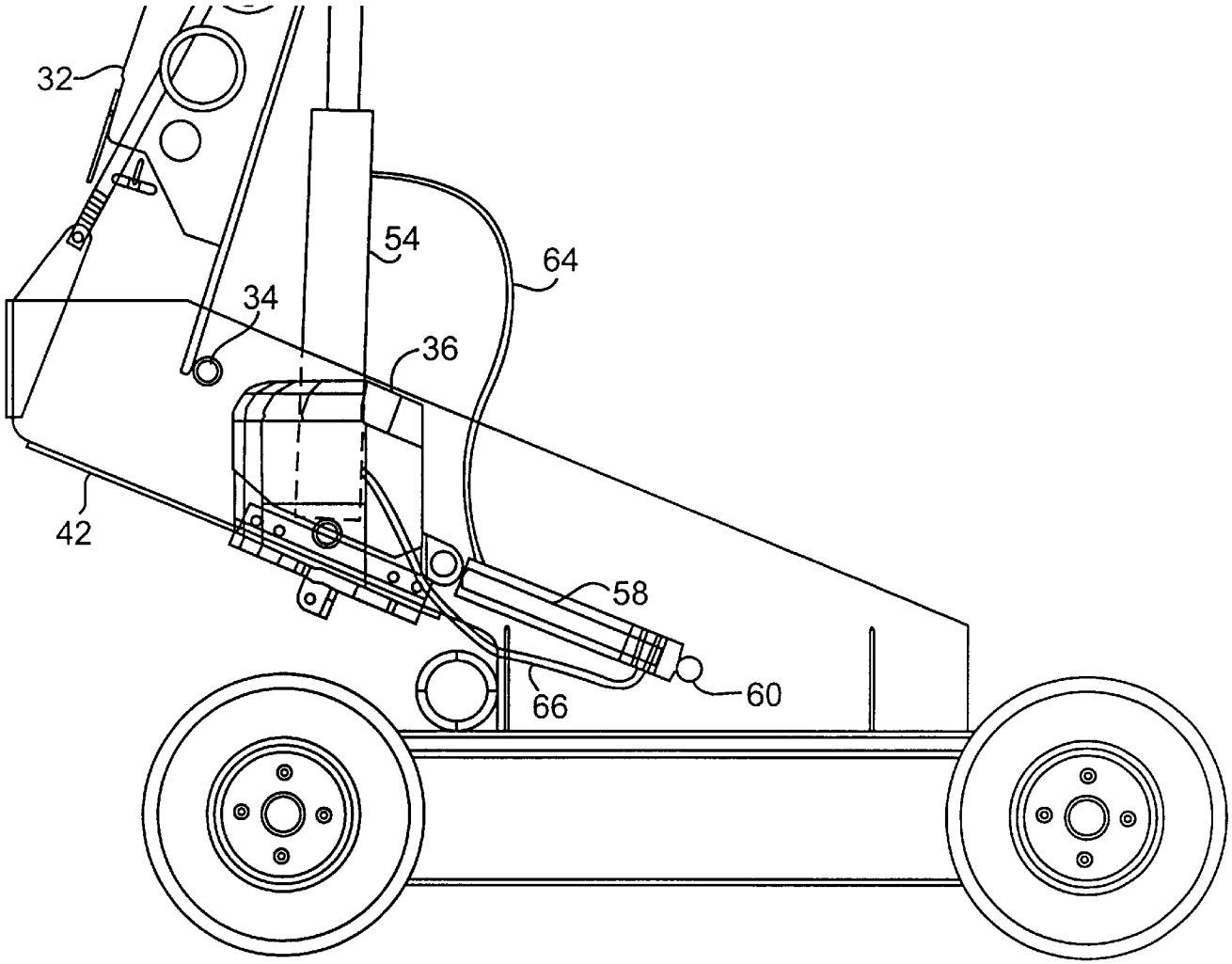
FIG. 6B is another view of the embodiment of FIG. 6A, showing the boom in a raised position.

FIGS. 6A–6B illustrate an alternate embodiment of the invention. Like the first-described embodiment, this embodiment includes a turret 30 mounted on a chassis 12. Boom 32 is pivotally mounted on turret 30 at pivot axis 34. This embodiment similarly includes movable counterweight 36 including portions secured to counterweight table 38, all of which is supported by wheels 40 on tracks 42. This embodiment also includes a hydraulic cylinder and piston lifting device 54 for raising and lowering the boom. This embodiment does not require, however, boom portion 32, link 46 and associated elements.

The embodiment of FIGS. 6A–6B comprises a second piston and cylinder device 58 for moving the counterweight 36 as the boom is pivoted. Device 58 is connected at point 60 to turret 30, and at point 62 to counterweight 36 by suitable coupling means.

Boom 32 is illustrated in FIG. 6A in approximately a horizontal position, raised slightly from its lowest position. In this horizontal position, the piston of device 54 is partially extended, and the piston of device 58 is partially retracted. Accordingly, with boom 32 slightly elevated in this manner, counterweight 36 has been moved a short distance downwardly and forwardly along tracks 42.

FIG. 6B illustrates the apparatus of FIG. 6A with boom 32 in the fully raised position. As illustrated, with the boom in this position, piston-cylinder device 54 is fully extended, while piston-cylinder device 58 is fully retracted, moving the counterweight 36 fully forward and downward along tracks 42.

Piston and cylinder device 54 is in a master-slave relationship with piston and cylinder device 58. As fluid is pumped into piston-cylinder device 54 in order to extend the piston and raise the boom, fluid flows from the piston side of that device through a conduit 64 into the piston side of device 58, causing device 58 to retract its piston. This moves counterweight 36 downwardly and forwardly along tracks 42. As this occurs, fluid leaves the opposite side of device 58 through a second conduit 66, flowing into the opposite side of device 54. When the boom is lowered, flow is in the opposite direction. The piston of device 58 is extended and the counterweight 36 is moved upwardly and rearwardly along tracks 42.

Figure 7:
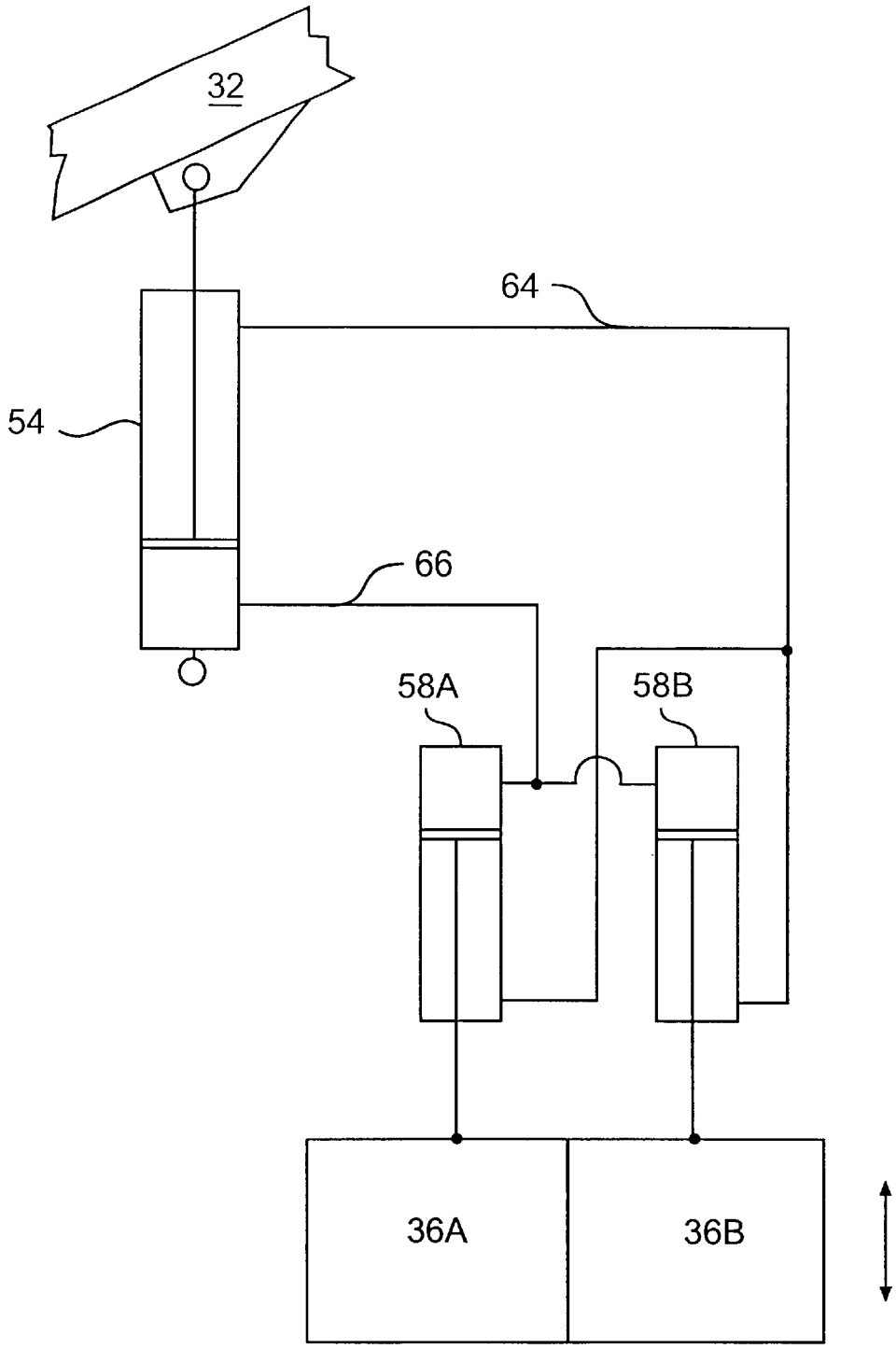
FIG. 7 is a schematic illustration of a master-slave hydraulic piston and cylinder arrangement suitable for the embodiment of FIGS. 6A–6B.

FIG. 7 further illustrates a master-slave arrangement suitable for hydraulic devices 54 and 58 of the embodiment of FIGS. 6A–6B. FIG. 7 illustrates the fact that hydraulic cylinder 58 for shifting the counterweight may actually comprise two parts, 58A and 58B, operating in parallel. Such an arrangement may be desirable with a construction as described above, comprising counterweight portions symmetrically arranged on opposite sides of the turret. In such a construction, it may be desirable to include symmetrically-operating piston and cylinder devices 58A and 58B connected to counterweight portions 36A and 36B, respectively. Such an arrangement makes it relatively easy to maintain the counterweight in alignment as it is moved along tracks 42. However, the invention is not limited to a device comprising any specific number of devices for shifting the counterweight.

Figure 8:
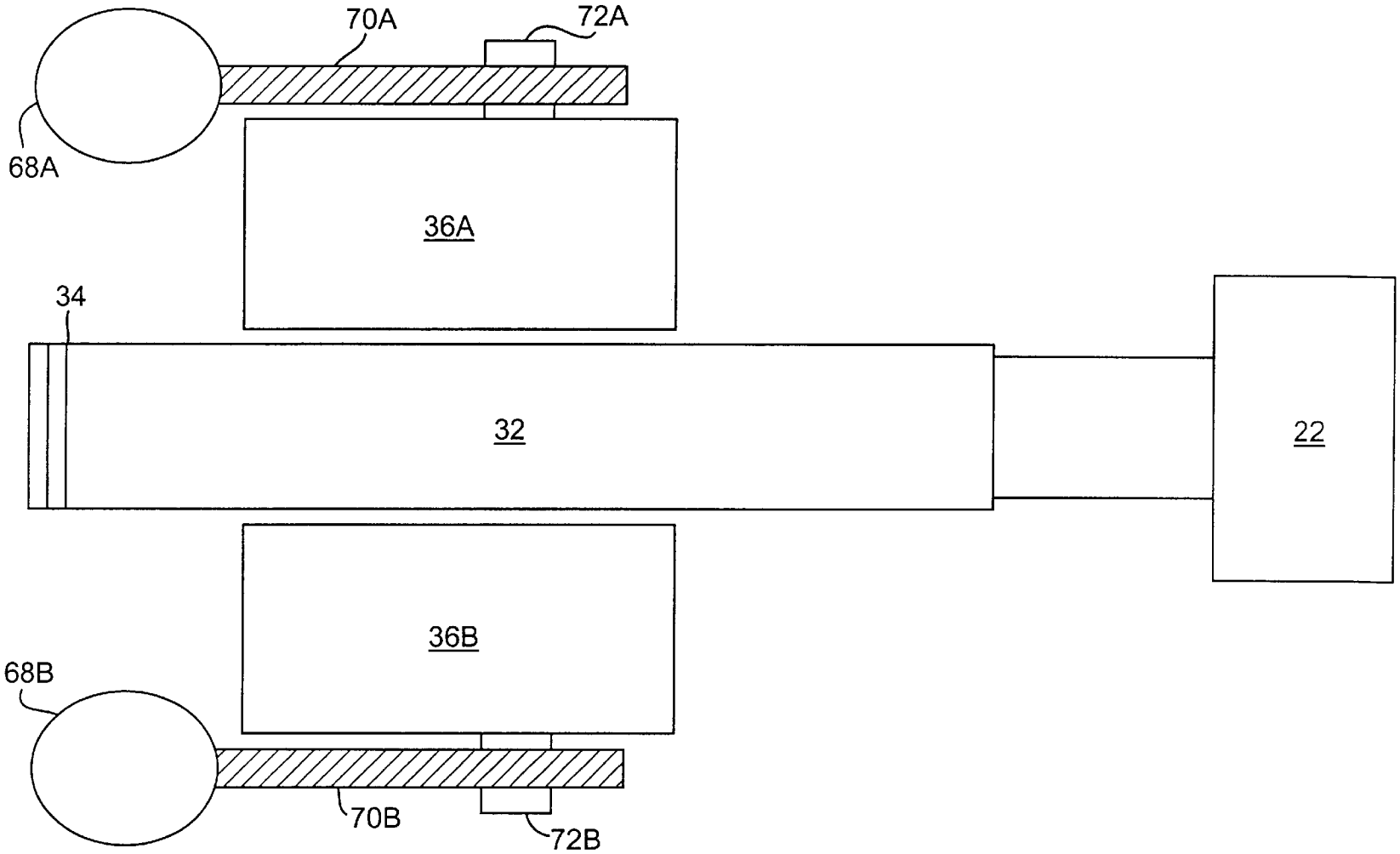
FIG. 8 illustrates another alternative drive arrangement for shifting the counterweight in an apparatus in accordance with the invention.

FIG. 8 illustrates an alternate embodiment of means for shifting the counterweight in accordance with the invention. This embodiment comprises a pair of reversible motors 68A and 68B suitably mounted on turret 30. The motors reversibly drive a pair of screws 70A and 70B. The screws cooperate with nuts 72A and 72B, respectively, attached to counterweights 36A and 36B. As motors 68A and 68B are driven in one direction or the other, the cooperation of screws 70A and 70B with nuts 72A and 72B will cause the counterweight portions to shift linearly along tracks 42, as previously described.

The arrangement of FIG. 8 comprises pairs of motors, drive screws, etc., corresponding to counterweight portions 36A and 36B of the preferred embodiments described above. Again, however, the invention is not limited to such a symmetrical arrangement, but contemplates structures having a single drive device or more than two drive devices.

Motors 68A and 68B may be powered electrically, hydraulically, or pneumatically. The position and direction of drive of the motors may be controlled by sensors which provide signals representing the position (elevation) of boom 32. Such sensors might determine, for example, the angle of rotation of the boom about pivot axis 34 from its lowermost position, the actual inclination of the boom, the actual height of the platform from ground level, the actual radial distance of the platform from a selected point on the apparatus, or any other parameter which may be utilized for control of the motors. Such control can be achieves by, for example, a microprocessor-controlled circuit for driving the motors and, thus, positioning the counterweight.

Figure 9:
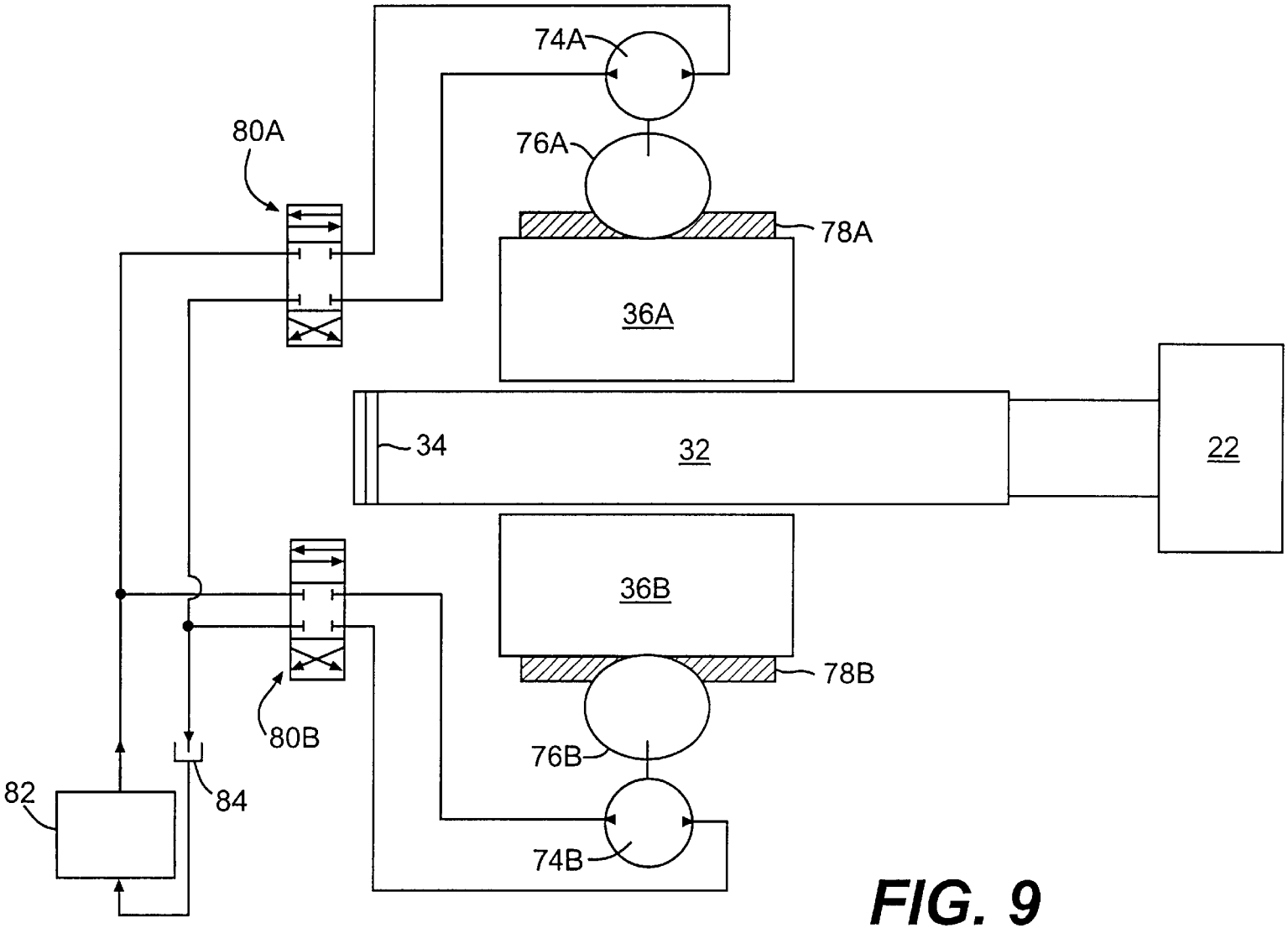
FIG. 9 illustrates a further alternative drive arrangement for shifting a counterweight in accordance with the invention.

FIG. 9 illustrates yet another embodiment of means for shifting the counterweight. This embodiment comprises a rack and pinion drive arrangement which includes a pair of reversible motors 74A and 74B associated with turret 30 and connected to a corresponding pair of pinions 76A and 76B. The pinions engage racks 78A and 78B, respectively, associated with counterweight portions 36A and 36B.

As illustrated, the motors are hydraulic or pneumatic reversible motors, driven from a supply 82 of fluid under pressure. The direction of fluid flow is controlled by a pair of three-way valves 80A and 80B. In the position illustrated, valves 80A and 80B are closed, and no fluid is flowing to the motors. These valves may be shifted to cause the motors to rotate either clockwise or counterclockwise in a well know manner. Fluid flowing through the motors returns to the supply via a reservoir 84.

As with the embodiment of FIG. 8, valves 80A and 80B may be controlled by devices which sense the angle or position of the boom and/or the platform of the aerial work platform apparatus. Reversible motors 74A and 74B need not be hydraulic or pneumatic, but may be electrically driven. As with the previously-described embodiments, the embodiment of FIG. 9 is also not limited to an arrangement comprising two symmetrically-disposed drives, but also contemplates a single drive for a counterweight, or more than two drives.

The invention has, thus, been described with reference to several embodiments. This description should not be considered as limiting, however, inasmuch as the invention contemplates variations of structure and proportion of elements consistent with the objectives heretofore described, the invention being defined solely by the appended claims.

We claim:

1. A load lifting apparatus which lifts or lowers a load by raising or lowering a boom carrying the load, comprising:

a boom pivotable about a horizontal axis for lifting and lowering the load, a first end of said boom extending to one side of said horizontal axis;

a load carrier associated with said first end of said boom for supporting the load carried by said load carrier;

said boom comprising a second end extending from said horizontal axis;

a linearly shiftable counterweight for balancing said lifting apparatus in response to movement of the load; and a rigid link connecting said second end of said boom to said counterweight for shifting said counterweight non-horizontally in a first direction when the load is lifted and in a second direction when the load is lowered.

2. The load lifting apparatus of claim 1, wherein said link shifts said counterweight in a direction generally toward said one side of said horizontal axis as the load is lifted and in a direction generally away from said one side of said horizontal axis when the load is lowered.

3. The load lifting apparatus of claim 1, wherein said link shifts said counterweight in a generally downward direction as the load is lifted and in a generally upward direction when the load is lowered.

4. The load lifting apparatus of claim 1, wherein said apparatus is an aerial work platform, and said load carrier is a platform associated with the first end of the boom.

5. The load lifting apparatus of claim 4, wherein said counterweight shifts linearly along a path inclined from a horizontal direction.

6. The load lifting apparatus of claim 5, wherein said counterweight shifts in a downward direction as said platform is lifted, and in an upward direction as said platform is lowered.

7. The load lifting apparatus of claim 1, wherein said counterweight shifts linearly along a path inclined from a horizontal direction.

8. The load lifting apparatus of claim 7, wherein said counterweight shifts in a downward direction as the load is lifted, and in an upward direction as the load is lowered.

9. The load lifting apparatus of claim 1, wherein said second end of said boom is non-linear with respect to said first end of said boom.

10. The load lifting apparatus of claim 9, wherein said link consists of a single link connecting said second end of said boom to said counterweight.

11. The load lifting apparatus of claim 9, wherein said second end of said boom extends at an angle downwardly from a plane containing the first end of said boom, and said counterweight is shifted downwardly as the load is lifted.

12. The load lifting apparatus of claim 1, wherein said boom and said counterweight are mounted on a rotatable structure which is rotatable about a vertical axis, wherein said counterweight shifts in a direction generally toward said vertical axis when the load is lifted and in a direction generally away from said vertical axis when the load is lowered.

13. The load lifting apparatus of claim 1, wherein said boom and said counterweight are mounted on a rotatable structure which is rotatable about a vertical axis, wherein said counterweight shifts in a direction generally toward said vertical axis as the load moves toward said vertical axis and in a direction generally away from said vertical axis as the load moves away from said vertical axis.

14. The load lifting apparatus of claim 12, wherein said apparatus is an aerial work platform, and the load carrier is a platform associated with said first end of said boom.

15. The load lifting apparatus of claim 13, wherein said apparatus is an aerial work platform, and the load carrier is a platform associated with said first end of said boom.

16. The load lifting apparatus of claim 1, wherein said boom and said counterweight are mounted on a rotatable structure which is rotatable about a vertical axis, wherein said counterweight is mounted to shift linearly on said rotatable structure.

17. The load lifting apparatus of claim 16, wherein said counterweight shifts along a path which is inclined from a horizontal direction.

18. The load lifting apparatus of claim 17, further comprising rollers for facilitating shifting of said counterweight.

19. The load lifting apparatus of claim 16, wherein said apparatus is an aerial work platform comprising said boom and said counterweight mounted on a rotatable turret, said turret comprising at least one track mounted on said turret and extending along a path which is inclined from a horizontal direction, said counterweight comprising at least one roller for facilitating shifting of said counterweight along said path.

20. A load lifting apparatus which lifts or lowers a load by raising or lowering a boom carrying the load, comprising:

a boom pivotable about a horizontal axis for raising and lowering the load;

a load carrier associated with said boom for supporting the load to be raised and lowered by pivoting said boom;

a shiftable counterweight shiftable linearly in opposite directions generally toward and away from said horizontal axis and in opposite directions generally upwardly and downwardly; and a rigid link for shifting said counterweight with respect to said horizontal axis and upwardly or downwardly in response to raising or lowering of the load.

21. The load lifting apparatus of claim 20, wherein said apparatus is an aerial work platform and the load carrier is a work platform mounted at a first end of the boom.

22. The load lifting apparatus of claim 21, wherein said counterweight shifts linearly along a line which is inclined from a horizontal direction.

23. The load lifting apparatus of claim 22, wherein said counterweight is supported on wheels, and said apparatus comprises a track for supporting said counterweight by said wheels and for guiding said counterweight in its movement along said line.

24. The load lifting apparatus of claim 23, wherein said boom is a straight boom, and said platform is mounted on a first end of said boom extending to one side of said horizontal axis;

said boom comprising a second end extending to a second side of said horizontal axis generally opposite to said first side; and said device for shifting said counterweight comprises a link connecting said second end of said boom to said counterweight.

25. The load lifting apparatus of claim 24, wherein said link shifts said counterweight in a direction generally toward said one side of said horizontal axis as the load is lifted and in a direction generally away from said one side of said horizontal axis when the load is lowered.

26. The load lifting apparatus of claim 24, wherein said link shifts said counterweight in a generally downward direction as the load is lifted and in a generally upward direction when the load is lowered.

27. The load lifting apparatus of claim 21, wherein said boom and said counterweight are mounted on a rotatable structure which is rotatable about a vertical axis, wherein said counterweight shifts in a direction generally toward said vertical axis when the load is lifted and in a direction generally away from said vertical axis when the load is lowered.

28. An aerial work platform apparatus comprising:

a boom pivotable about a horizontal axis, a first end of said boom extending to one side of said horizontal axis;

a work platform supported on said first end of said boom movable vertically and horizontally by pivotal movement of said boom;

said boom comprising a second end extending from said horizontal axis;

a linearly shiftable counterweight for balancing said apparatus in response to said horizontal and vertical movement of said platform; and a rigid link connecting said second end of said boom to said counterweight for shifting said counterweight non-horizontally in a first direction when said boom is pivoted in a direction to lift said platform and in a second direction when said boom is pivoted in a direction to lower said platform.

29. An aerial work platform comprising:

a boom pivotable about a horizontal axis, a first end of said boom extending to one side of said horizontal axis;

a work platform supported on said first end of said boom;

said boom comprising a second end extending from said horizontal axis;

a linearly shiftable counterweight; and a rigid link connecting said second end of said boom to said counterweight for shifting said counterweight non-horizontally in a first direction when said boom is pivoted to lift said platform and in a second direction when said boom is pivoted to lower said platform.

* * * * *